United States Patent [19]

Nye

[11] Patent Number: 4,836,253

[45] Date of Patent: Jun. 6, 1989

[54] CONTAINER VALVE AND FILLING MEANS

[76] Inventor: Norman H. Nye, 1348 High Bridge Rd., Cuyahoga Falls, Ohio 44223

[21] Appl. No.: 21,143

[22] Filed: Mar. 3, 1987

[51] Int. Cl.[4] ..... B65B 3/00

[52] U.S. Cl. ..... 141/18; 141/348; 141/59

[58] Field of Search ..... 141/1–12, 141/18–29, 59, 85–92, 348, 349, 350, 351, 352, 353, 354, 355; 222/149–151, 400.7, 402.12, 402.16; 137/237–246

[56] References Cited

U.S. PATENT DOCUMENTS

| | | | |
|---|---|---|---|
| 3,158,298 | 11/1964 | Briechle | 141/21 |
| 3,180,374 | 4/1965 | Muller | 141/20 |
| 3,476,507 | 11/1969 | Leeds | 141/348 X |
| 4,137,954 | 2/1979 | Brill et al. | 141/90 |

FOREIGN PATENT DOCUMENTS

| | | | |
|---|---|---|---|
| 2800702 | 7/1978 | Fed. Rep. of Germany | 141/348 |
| 1368185 | 6/1964 | France | 141/348 |

*Primary Examiner*—Ernest G. Cusick
*Attorney, Agent, or Firm*—Oldham & Oldham Co.

[57] ABSTRACT

A container for receiving and retaining contents under pressure is provided with an improved valve structure to prevent contamination of the discharge valve during the filling operation. The valve structure includes a check valve which is opened when filling the container, and a sealing element which engages and surrounds a filling tube thereby preventing the contents from reaching the discharge valve. Additionally, purging of the discharge mechanism will clean the same of any residue that may be found therein.

4 Claims, 1 Drawing Sheet

CONTAINER VALVE AND FILLING MEANS

FIELD OF THE INVENTION

This invention relates to the container industry, especially to the type of container in which the contents are dispensed by gas pressure or more particularly by the pressure produced by an elastic sleeve surrounding the container.

RELATED APPLICATIONS

A container of the type to which this invention is related is illustrated in a patent issued to Hyman Katz, U.S. Pat. No. 4,423,829.

DISCUSSION OF PRIOR ART

Containers of the type in which the pressure to discharge the contents is produced by an elastic sleeve are usually filled by flowing the content material through the discharge valve. After the filling operation, some of the content material remains as a residue in the valve mechanism. Usually there is a considerable time lapse between the time when the container is filled and the time when the contents are used. If the contents of the container are of such a nature that drying or congealing can take place, such as may happen if the contents are a paste or adhesive or certain other substances, then the valve mechanism may become clogged or inoperative. It is also possible that detrimental bacterial growth may take place in such residue.

OBJECT OF THE INVENTION

This invention provides a means for eliminating or very much reducing the contamination of the discharge valve mechanism when the filling of a container takes place and it also provides a means for flushing out any small residue of material that may remain after the filling operation is completed.

DETAILED DESCRIPTION

Figure 1:
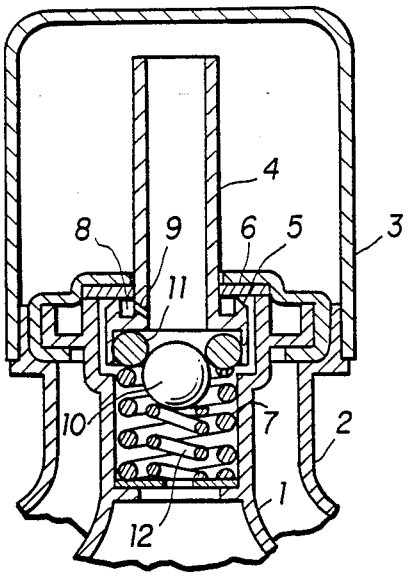
FIG. 1 is an enlarged sectional view of a valve mechanism that is designed to embody the invention and that contains a ball type check valve and an "O" ring sealing device.

Referring now to the drawings 1 is an inner container for holding under pressure the contents of material to be dispensed. This inner container may be similiar to a container shown on U.S. Pat. No. 4,423,829 issued to Hyman Katz. An outer shell 2 is often provided to protect the inner container and it may be decorative and be printed with instructions or other pertinent matter. A cap 3 is usually provided to protect the valve from being inadvertently actuated. A spout 4 is shown. This type of spout is quite usually used for dispensing pastes or adhesives or other high viscosity materials. However, a spray type of dispensing head (Not shown) may be added if a fine spray is desired. A ring 5 having a knife edge is made integral with the spout 4 and contacts a washer 6 that fits around the spout and is made of a soft material, usually rubber. The washer 6 acts as a sealing surface for the spout 4 via ring 5. A spring 7 is provided to hold the ring 5 tightly against the washer 6 to form a seal to prevent discharge of the contents of the container. The combination of the ring 5, the washer 6, the spout 4, the spring 7 constitutes a valve. Tilting the spout sideways causes the ring 5 to partially disengage washer 6 and allows the contents of the container to pass into chamber 8 and then through metering aperture 9 into the spout 4 and out for use. The type of valve here described is similiar to what has normally been used in part art.

Figure 3:
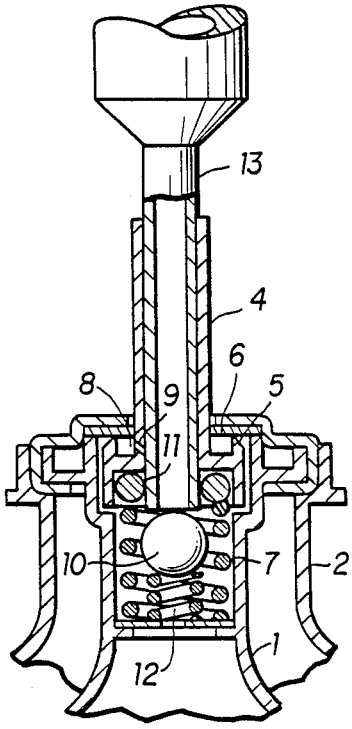
FIG. 3 is an enlarged sectional view showing the valve mechanism as shown in FIG. 1, with a filling tube in place for filling the container and it illustrates how the dispensing valve mechanism is isolated and sealed off from the filling operation.

In order that the container 1 may be filled without the content material passing through metering aperture 9, chamber 8, and past ring 5, a check valve is provided through which the material may pass during the filling operation. FIG. 1 illustrates one type of check valve consisting of a ball 10, "O" ring 11, and a spring 12. FIG. 3 illustrates a container being filled by means of filling tube 13 that is inserted and fit closely in the inside diameter of spout 4. The filling tube is pushed through "O" ring 11. The material being injected under pressure into the container 1 through filling tube 13 will depress the ball 10 and allow the material to pass through. The "O" ring 11 will engage and seal around filling tube 13 and will prevent any of the material from reaching aperture 9 and subsequently chamber 8. As filling tube 13 is retracted after the container 1 is filled, it is in most cases necessary to reduce the pressure of the material in the filling tube 13 to zero or even a vacuum so as to not contaminate the inside of spout 4 and to minimize the amount of residue of material that is left.

Figure 4:
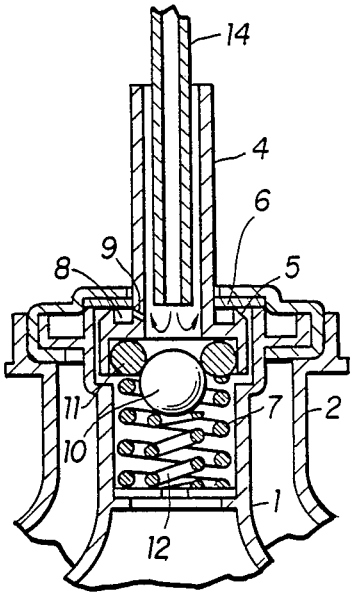
FIG. 4 is an enlarged sectional view showing how a purging operation for removing any small remaining residue of material can be accomplished if needed after the filling operation is completed.

In order to completely sanitize the interior surfaces after filling it may be desirable to purge using a cleaning fluid in a manner shown in FIG. 4, in which manner a tube 14 is inserted loosely into spout 4 and the cleaning fluid is flowed through to flush out any residue that may remain.

Figure 2:
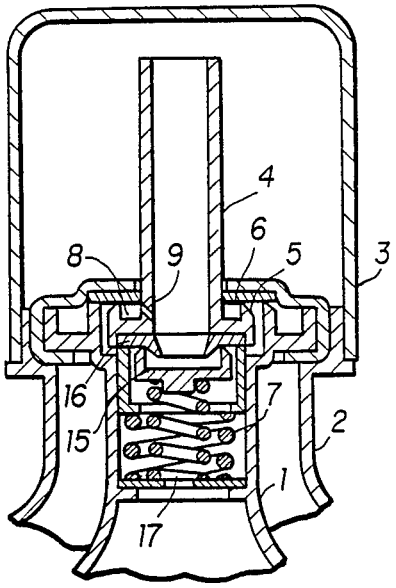
FIG. 2 is an enlarged sectional view of a valve mechanism that operates in a manner similiar to that shown in FIG. 1, but shows a different type of check valve and a different type of sealing means.

FIG. 2 illustrates an alternate type of check valve in which a member 15 having a knife edge ring is pressed against a resilent rubber sealing washer 16 by spring 17. The resilient rubber sealing washer 16 has integral therewith a sealing lip that engages and surrounds the filling tube and seals thereagainst during the filling operation. The member 15 is depressed by the pressure of the material being injected into the container 1 and the operation is the same as in described and illustrated in connection with FIG. 3.

The foregoing description has been given for clearness of understanding only and no unnecessary limitations should be understood therefrom as modifications will be obvious to those skilled in the art such as the use of different types of check valves or seals. The scope of the invention should be limited only by the appended claims.

I claim:

1. A container capable of receiving and retaining contents under pressure comprising;

a discharge valve mechanism for controlling the dispensing of said contents in said container comprising a sealing surface, a chamber releasably sealed against said sealing surface, a metering aperture connecting said chamber to a discharge spout;

said metering aperture is of such a size as to limit the rate of discharge of said contents that pass through said discharge valve mechanism into said discharge spout;

a tubular filling means arranged to enter into said discharge spout for the purpose of filling said container with said contents;

a check valve associated with said discharge valve mechanism for allowing said contents to flow from said tubular filling means into said container, but preventing the discharge of said contents when said tubular filling means is removed;

sealing means adapted to engage and surround said tubular filling means located between said check valve and said metering aperture to prevent said contents from reaching said metering aperture while the filling operation is taking place.

2. A container as in claim 1 with the addition of a purging means for the purpose of removing residue of said contents from said discharge valve mechanism and said discharge spout after the operation of filling of said contents into said container is completed.

3. A container as in claim 1 wherein; said check valve is comprised of a valve means being biased into a closed position and seated against said sealing means to prevent said contents from being discharged through said discharge passageway.

4. A container as in claim 1 wherein; said valve means may be displaced from said closed position by said tubular filling means such that said contents may flow in said container.

* * * * *